United States Patent [19]

Ulbrich

[11] 3,933,010

[45] Jan. 20, 1976

[54] PROFILE WIRE RING

[76] Inventor: Josef Ulbrich, Sudetenstrasse 86-88, 8950 Kaufbeuran-Neugablonz, Germany

[22] Filed: May 28, 1974

[21] Appl. No.: 474,075

[30] Foreign Application Priority Data

June 1, 1973 Germany ..... 20584[U]

[52] U.S. Cl. ..... 63/15.6; 29/60.6; 29/509

[51] Int. Cl.[2] ..... A44C 9/02

[58] Field of Search ..... 63/15.6; 29/509, 160.6

[56] References Cited

UNITED STATES PATENTS

| | | | |
|---|---|---|---|
| 345,655 | 7/1886 | Wood | 29/509 UX |
| 2,184,942 | 12/1939 | McDonald | 63/15.6 X |
| 2,541,415 | 2/1951 | Grafstein | 63/15.6 |
| 3,711,931 | 1/1973 | Ladouceur et al. | 29/509 UX |

FOREIGN PATENTS OR APPLICATIONS

| | | | |
|---|---|---|---|
| 376,142 | 7/1932 | United Kingdom | 63/15.6 |

*Primary Examiner*—F. Barry Shay
*Attorney, Agent, or Firm*—Holman & Stern

[57] ABSTRACT

A profile wire ring as a component for the production of finger rings consisting of a first ring and a second wire spring ring attached to the inner side of the first ring in a groove. The second wire spring ring is held by swaged or deformed lugs, on the first ring, made opposite each other from the material of the profile ring.

1 Claim, 4 Drawing Figures

FIG. 1
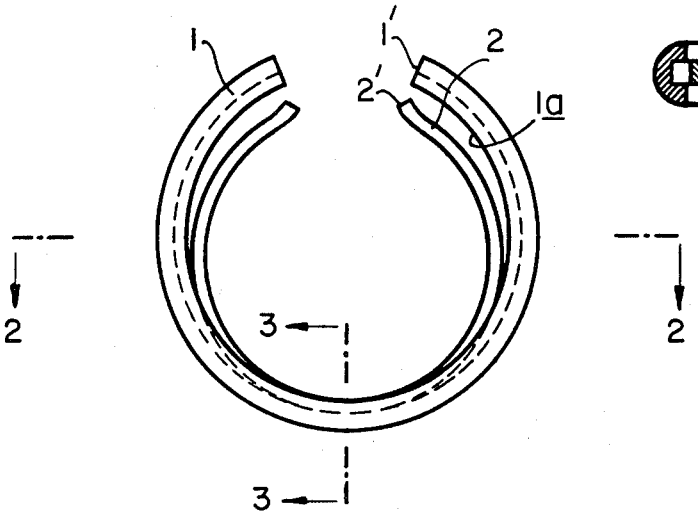
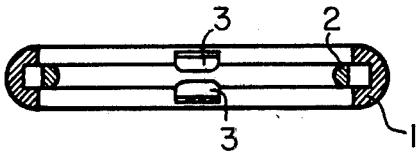
FIG. 2
FIG. 3
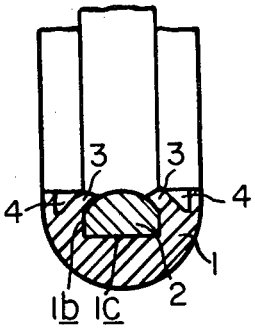
FIG. 4
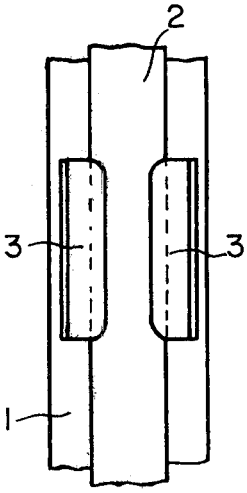

PROFILE WIRE RING

BACKGROUND OF THE INVENTION

The invention relates to the construction of a profile wire ring, that is to say a ring of wire with a particular non-circular cross-section, adapted for use as a component for the production of a finger ring, which consists of a first ring and a second spring wire ring fixed on the inner side of the first ring in a groove.

PRIOR TECHNIQUES

Such profile wire rings have been proposed in the most various different constructions. Up until the present time they have always been made as open rings. In the opening, decoration or jewel mounts are arranged, which close the open ring. In the case of such profile wire rings, the inner resilient wire spring ring serves to allow for differences in diameter between the finger and the finger ring.

A profile wire ring has been proposed in the case of which the wire spring ring is soldered into the internal recess of the profile ring. In the case of such a profile wire ring, there is the disadvantage that the solder must be applied in the precise quantity desired. Superfluous solder can escape to the outside and the excess solder makes the part unsuitable for further processing.

Proposals have also been made to produce profile wire rings in a continuous process by means of a temperature and time controlled gas or electric chamber furnace by soldering. In this case as well, the profile wire ring may be impaired in appearance by escaping solder. Furthermore, the production of the profile wire rings in this manner is expensive because automatically operating equipment must be employed.

Finally, a profile wire ring has been proposed in the case of which the wire spring ring is attached in the profile ring by means of spot welding. In this respect there is, however, the danger that at the contact points or spots of the electrodes on the profile ring burns will be produced, which make the profile wire ring useless for further processing.

OBJECT AND SUMMARY OF THE INVENTION

One object of the present invention is to provide a profile wire ring which avoids these disadvantages.

The invention consists of a profile wire ring as a component for the production of finger rings consisting of a first ring and a second wire spring ring attached to the inner side of the first ring in a groove, characterized in that the second wire spring ring is held by swaged or deformed lugs, on the first ring, made opposite each other from the material of the first ring. This attachment makes it possible to avoid the formation of blobs of escaping solder and it is also possible to avoid burns due to spot welding. The profile wire ring presents a clean appearance when looked at from any direction so that it can be further processed without rejects.

BRIEF DESCRIPTION OF THE DRAWINGS

The drawing shows an embodiment of the invention.

FIG. 1 shows in elevation the first ring with the second wire spring ring placed in it, FIG. 2 is a sectional view in accordance with the section line 2—2 of FIG. 1, FIG. 3 is a sectional view in accordance with the sections 3—3 in FIGS. 1 and 2 and FIG. 4 is on an enlarged scale, a view of the lug-like lobes, by means of which the second wire spring ring is held in the first ring.

DETAILED DESCRIPTION OF THE INVENTION

The profile wire ring shown in FIG. 1 consists of a first outer ring 1 provided with an opening 1′ and a second wire spring ring 2 attached on the inner side of the profile ring. FIG. 2 shows a sectional view and simultaneously a plan view of the attachment of the second wire spring ring 2 in the first ring 1 by means of lugs 3, which hold the wire spring ring 2 in the first ring 1 from opposite sides.

FIG. 3 shows on an enlarged scale the attachment of the cut second wire spring ring 2 by the lugs 3, which have been produced by driving in notches 4 so that the lugs 3 consist of the same material as the first ring 1. FIG. 4 shows a plan view of the attachment of the second wire spring ring 2 by means of lugs 3.

More specifically, the first ring 1 has a smoothly curved inner side 1*a* provided with a groove 1*b* extending along the whole length of the inner side and the groove is shaped in transverse section like a U with a flat bottom 1*c*.

The second ring 2 has an opening 2′ radially inwardly adjacent to the opening 1′ of the first ring 1, with the opening in the first ring serving for the subsequent insertion of a decoration mount.

The second ring 2 is arranged in a recessed manner in the groove 1*b* of the first ring 1 at a location generally opposite to the openings and the lugs 3 clamp the first and second rings in fixed relation with the bottom of the second ring 2 conforming to the bottom 1*c* of the groove 1*b*, with the lugs being swaged from the material of the first ring 1 so that neither the second ring 2 nor the lugs 3 extend radially inwardly from the smoothly curved inner side 1*a* at the location of the lugs.

I claim:

1. A profile wire ring as a component for the production of finger rings, consisting of a first ring provided with an opening, said first ring being a profile ring and having a smoothly curved inner side provided with a groove extending along the whole length of said inner side, said groove being shaped in transverse section like a U with a flat bottom, and a second ring arranged in said groove, said second ring being resilient and having an opening radially inwardly adjacent to the opening of the first ring, the opening in the first ring serving for the subsequent insertion of a decoration mount, the second ring being arranged in a recessed manner in said groove at a location generally opposite to said openings, and means clamping said first and second rings in fixed relation with the bottom of said second ring conforming to the bottom of said groove, said means comprising two oppositely arranged lugs swaged from the material of the first ring in such a manner that neither the second ring nor the lugs extend radially inwardly from said smoothly curved inner side at the location of said lugs.

* * * * *